US005535450A

United States Patent [19]

Melzer

[11] Patent Number: 5,535,450

[45] Date of Patent: Jul. 16, 1996

[54] WRAP-AROUND PANTS

[75] Inventor: Renee Melzer, New York, N.Y.

[73] Assignee: Renee Melzer/Creative Concepts, Inc., New York, N.Y.

[21] Appl. No.: 422,304

[22] Filed: Apr. 13, 1995

[51] Int. Cl.[6] ..... A41D 1/06

[52] U.S. Cl. ..... 2/69; 2/227

[58] Field of Search ..... 2/69, 70, 79, 80, 2/227, 228, 238, 243.1, 114

[56] References Cited

U.S. PATENT DOCUMENTS

| | | | |
|---|---|---|---|
| D. 29,162 | 8/1898 | Buren . | |
| D. 42,566 | 5/1912 | Salzenstein . | |
| D. 122,186 | 8/1940 | Ranuzzi . | |
| D. 257,697 | 12/1980 | Angrisano et al. . | |
| D. 274,670 | 7/1984 | Smith . | |
| 2,520,026 | 8/1950 | Beitchman . | |
| 3,359,569 | 12/1967 | Rotanz et al. . | |
| 3,800,330 | 4/1974 | Bowcut . | |
| 3,843,971 | 10/1974 | Delanty et al. . | |
| 3,855,635 | 12/1974 | Ramirez . | |
| 4,068,315 | 1/1978 | Rainville | 2/114 |
| 4,145,763 | 3/1979 | Abrams et al. . | |
| 4,258,440 | 3/1981 | McGowan . | |
| 4,422,186 | 12/1983 | Loney . | |
| 4,434,511 | 3/1984 | Weiser . | |
| 4,651,353 | 3/1987 | Walden | 2/227 |

FOREIGN PATENT DOCUMENTS 2027330 2/1980 United Kingdom .

*Primary Examiner*—John J. Calvert
*Assistant Examiner*—Gloria Hale
*Attorney, Agent, or Firm*—Darby & Darby

[57] ABSTRACT

A pair of pants formed from a blank of material that may be laid substantially flat, and a method of wrapping a blank of material around a wearer to form a pair of pants with smooth legs. The blank of material is preferably formed of four substantially standard-shaped pant leg panels sewn only along the inseam and crotch seam. Because each panel has a substantially standard pant leg shape, the blank formed from the connected panels has areas of excess fabric when the blank is laid out on a flat surface. The areas of excess fabric allow for the formation of smooth pant legs and front and back pant portions between the waist and legs upon wrapping the material around a wearer. The material is wrapped around the wearer like a diaper—first the back portion of the material is secured at the front of the wearer's waist, then the front portion of the material is pulled through the legs of the wearer, pulled up to the waist, wrapped around the wearer, and overlapped and secured over the back portion of the material, thereby forming pant legs having overlapped outer sides. Any desired closing means may be used to secure the front and back portions of the material around the wearer's waist.

14 Claims, 6 Drawing Sheets

WRAP-AROUND PANTS

BACKGROUND OF THE INVENTION

The present invention relates to comfortable pants for women that are easy-fitting and do not restrict the wearer's body or legs. More particularly, the present invention relates to pants that may be wrapped around the wearer and are easily adjustable in size.

Several styles of pants are currently available in the clothing industry that are relaxed and easy-fitting. Such pants include leggings (snug-fitting pull-on pants) and drawstring or elastic waist pull-on pants (such as sweatpants). Leggings, though sleek fitting, are very sporty and not always appropriate for more formal occasions. Moreover, leggings often fit very tightly, thereby accentuating a woman's heaviness or her lumpy thighs. Thus, many women will not wear leggings. Drawstring and elastic waist pants have a nice, roomier leg, but are not otherwise flattering. The excess fabric at the shirred waistband of such pants tends to make the wearer look heavier.

A recent addition to the pants market is sarong pants that have legs the wearer steps into and a wrap-around portion at the waist. These pants fit better in the rear than the above-described pants, but create a bulky look at the belly where the front panel is tied.

SUMMARY OF THE INVENTION

A principal object of the present invention is to provide a comfortable pair of pants that is not only easy-fitting and suitable for various occasions, but also slenderizing and flattering to the wearer.

A related object of the present invention is to provide a pair of pants that is adjustable in size.

A further related object of the present invention is to provide a pair of pants with pant-legs that allow the wearer unrestricted leg movement for ultimate comfort.

These and other objects of the invention are accomplished according to the principles of this invention by providing a pair of pants formed of a textile single blank of fabric or paper and a method for wrapping the blank around the wearer, through the wearer's legs like a diaper, to result in a pants configuration. In accordance with the principles of the present invention, the fabric blank has a back portion that is wrapped around the wearer from back to front. The back portion has a waistband that is wrapped around the wearer and secured at the front of the wearer's waist. The material of the blank is then pulled through the wearer's legs, from back to front. The front portion of the blank has a waistband that is raised to the level of the wearer's waist. The method of wrapping the material around the wearer to reach a pants configuration is completed by wrapping the waistband on the front portion of the blank around the wearer and securing the front waistband at the back of the wearer's waist.

These and other objects, features, and advantages of the present invention will be readily apparent from the following detailed description of the invention taken in conjunction with the accompanying drawings wherein like reference characters represent like elements, the scope of the invention being set out in the appended claims.

DETAILED DESCRIPTION OF THE INVENTION

Figure 1:
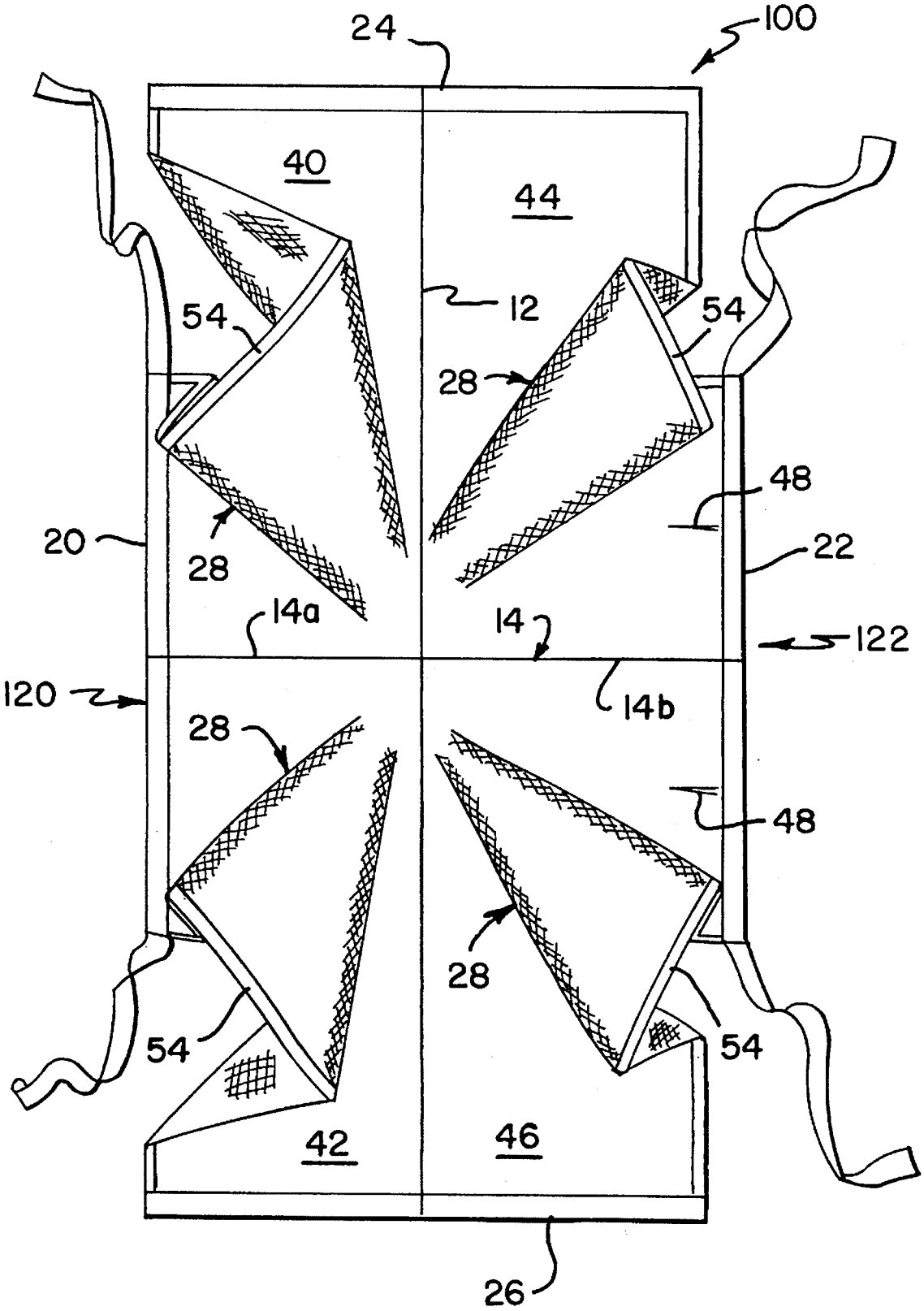
FIG. 1 is a plan view of a blank of material for forming the pants of the present invention, laid essentially flat and viewed from the inside.

The pants 10 of the present invention are formed of a blank 100 of fabric shown in FIG. 1 from the inside. Any desired type of material may be used. For example, chiffon, silk, or velvet may be used for dressy pants; rayon, cotton, or knit may be used for sporty pants; or wool, leather, or suede may be used for tailored pants. The garment of the invention may also be fabricated from paper. When blank 100 is in the substantially flat, laid out position of FIG. 1, inseam 12 and crotch seam 14 are each substantially straight. Additionally, inseam 12 and crotch seam 14 are substantially perpendicular to each other in the configuration of FIG. 1. Moreover, in the substantially flat configuration, front edge 20 of front portion 120 of blank 100 is substantially parallel to back edge 22 of back portion 122 of blank 100, and right edge 24 of blank 100 is substantially parallel to left edge 26 of blank 100. However, for blank 100 to fit around the waist of a wearer to form a smooth, unbunched pants configuration, blank 100 can only be made to lay substantially flat, as shown in FIG. 1. Blank 100 is formed of preferably four pant-leg panels that are shaped to form the smooth-fitting pants 10 shown in FIGS. 2 and 3. Because each panel is shaped like a pant-leg, each pant-leg panel cannot lay completely flat, resulting in areas of excess fabric 28 when blank 100 is laid as in FIG. 1. The shape of each panel of blank 100 will be discussed in further detail below.

Figure 2:
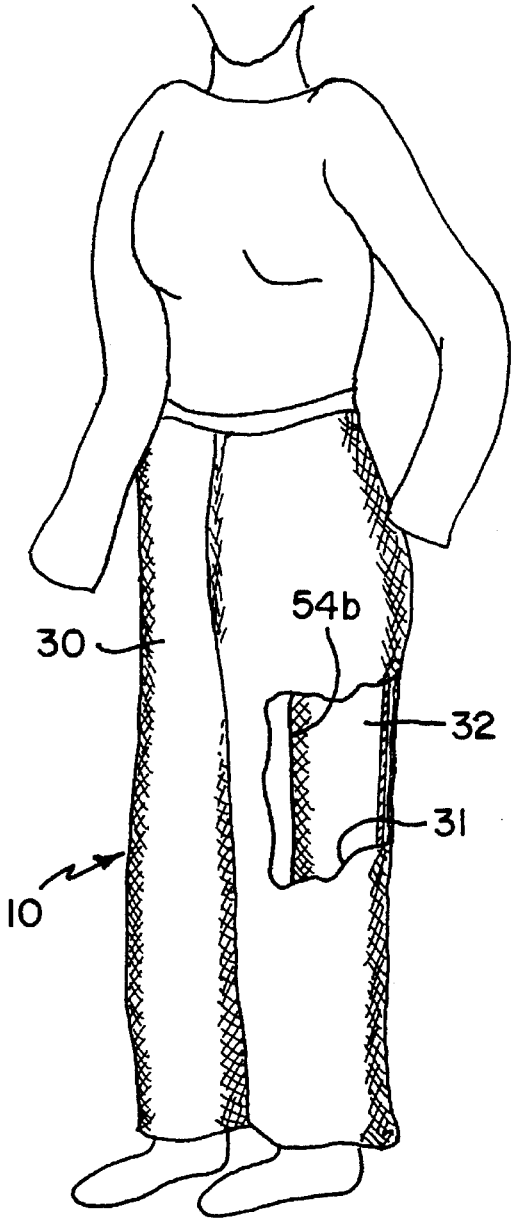
FIG. 2 is an isometric view of the pants of the present invention wrapped around a wearer and viewed from the front of the wearer.
Figure 3:
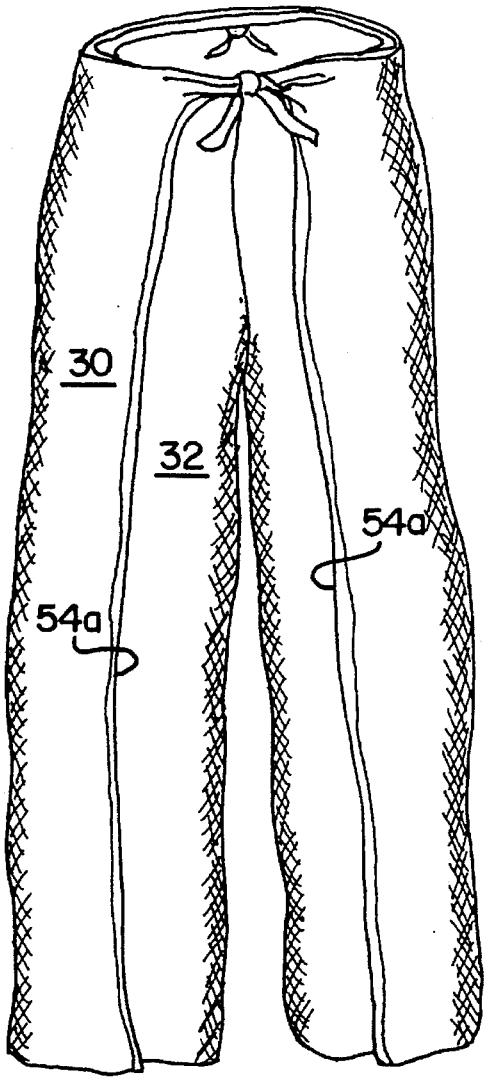
FIG. 3 is an isometric view of the pants of the present invention wrapped around a wearer and viewed from the back of the wearer.
Figure 4:
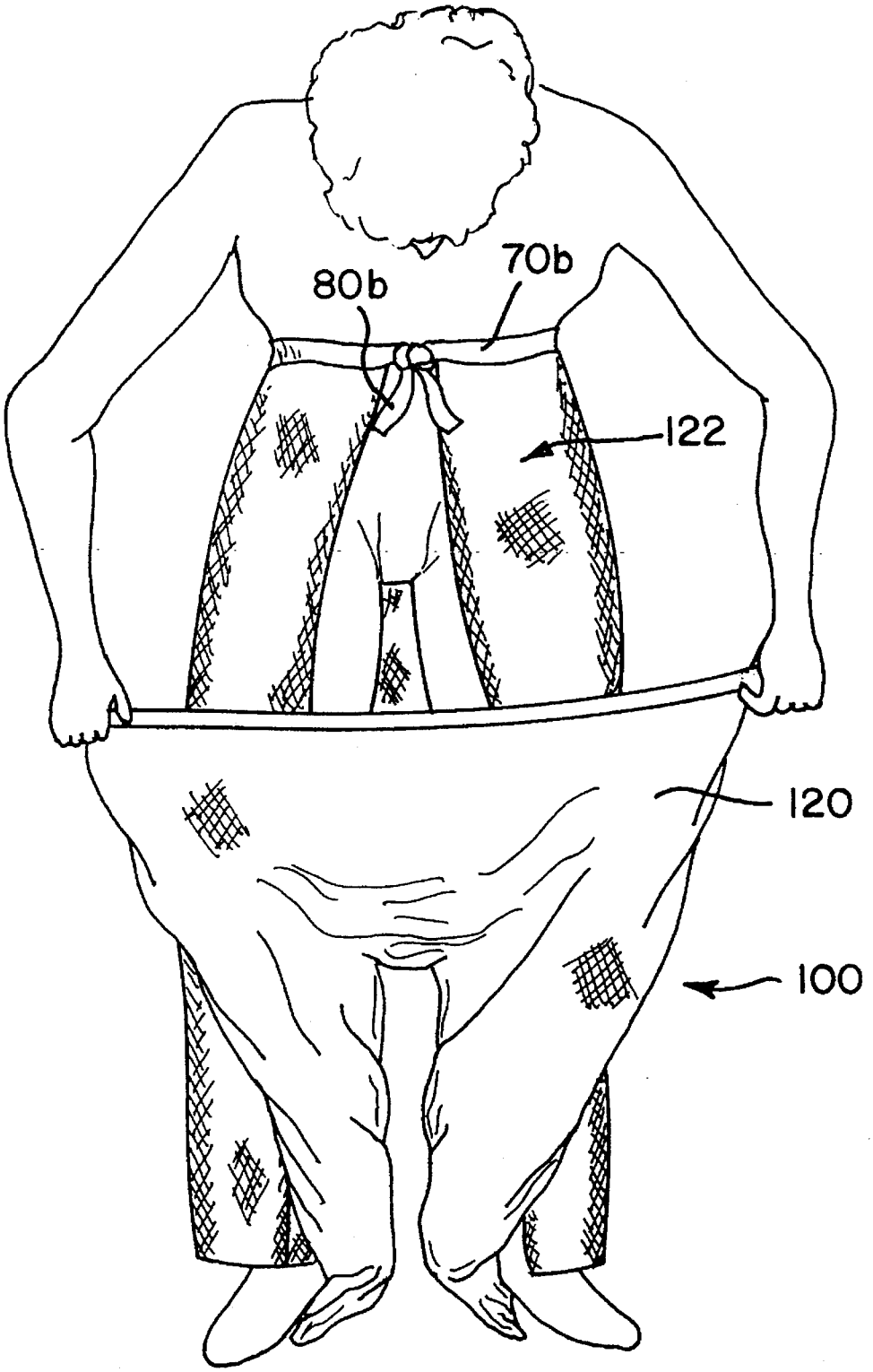
FIG. 4 is an isometric view of the blank of FIG. 1 in the process of being wrapped around a wearer in accordance with the method of the present invention.

Blank 100 is wrapped around the waist and legs of a wearer in accordance with the method of the present invention by wrapping the back blank portion 122 around the wearer's waist, pulling the remainder of blank 100 through the wearer's legs, as shown in FIG. 4, and securing front blank portion 120 around the front of the wearer's waist. The wrapped pants fit the wearer as shown in FIG. 2. As may be seen, the fit of the pants on the wearer is smooth and sleek. The front portion 30 of pants 10 gracefully wraps around the wearer so that pants 10 look like ordinary step-in pants when viewed from the front. The back portion 32 of pants 10 is wrapped under front portion 30, as can be seen at cut-away 31 in front portion 30. This overlap creates a modified "apron" look at the back of the wearer, as may be seen in FIG. 3. The resulting look is somewhat like a pair of chaps, but, unlike chaps, there is a back portion 32 to create a full pair of pants (rather than just a front covering). This fit is more flattering than the fit of other casual pants of the prior art, especially for women with a somewhat broader backside. The fit of pants 10 as shown in FIGS. 2 and 3, and the method of donning the pants, will be discussed in further detail below, after a more detailed description of the design of the blank 100 from which pants 10 are formed.

Figure 5:
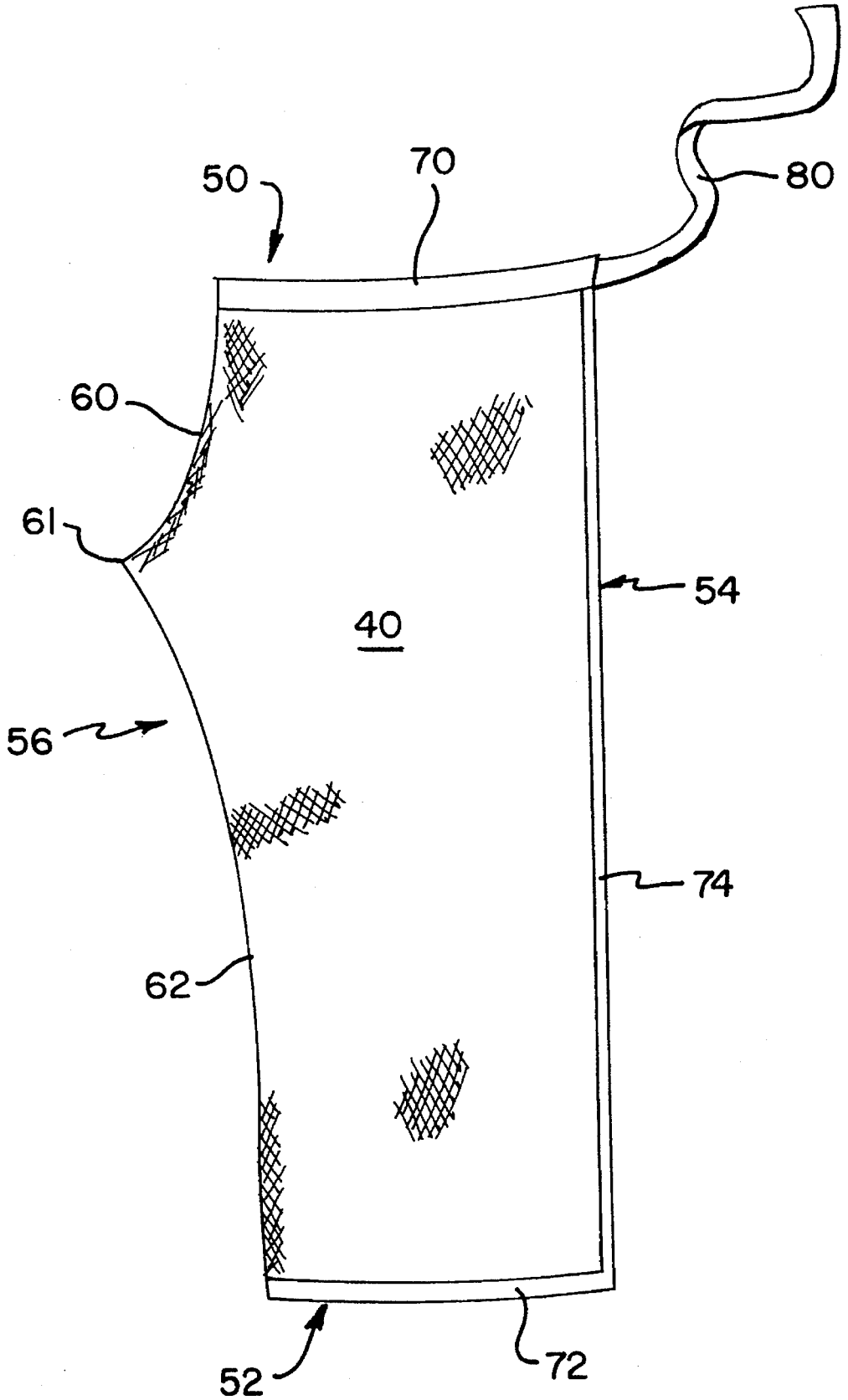
FIG. 5 is a plan view of a single panel, laid flat, of the blank of FIG. 1.

Blank 100 has a front blank portion 120 for forming smooth-fitting front portion 30 of pants 10, and a back blank portion 122 for forming smooth-fitting back portion 32 of pants 10. Front blank portion 120 is joined to back blank portion 122 along inseam 12. Each of front blank portion 120 and back blank portion 122 is formed of a right and left pant leg panel symmetrical about crotch seam 14. Specifically, front blank portion 120 is formed of a right front pant leg panel 40 and a left front pant leg panel 42, which panels are sewn together at, and are symmetrical about, front crotch seam 14*a*. Likewise, back blank portion 122 is formed of a right back pant leg panel 44 and a left back pant leg panel 46, which panels are sewn together at and are symmetrical about back crotch seam 14*b*. Each pant leg panel 40, 42, 44, and 46 of blank 100 has a substantially similar shape. Adjacent pant leg panels 40 and 44 are mirror image versions of each other, as are pant leg portions 42 and 46. However, the dimensions of front pant leg panels 40 and 42 are different from the dimensions of back pant leg panels 44 and 46. Specifically, the back pant leg panels 44, 46 are slightly longer along back edge 22, crotch seam 14*b*, and right and left edges 24, 26. Edges 24 and 26 form the bottom edges of the pant leg panels, as seen in FIG. 5. Moreover, each of back pant leg panels 44, 46 has a dart 48 that provides a better fit at the rear of the wearer when blank 100 is wrapped into a pants configuration around the wearer.

The right front pant leg panel 40 of blank 100 is shown laid flat in FIG. 5, without an area of excess material 28 as in FIG. 1. Because each pant leg panel 40, 42, 44, 46 of blank 100 has substantially the same shape (but differing dimensions), for the sake of simplicity, it will be understood that the reference numerals used with respect to pant leg panel 40 in FIG. 5 are applicable to corresponding elements in remaining pant leg panels 42, 44, and 46.

The shape of the pant leg panel used in blank 100 is substantially the same as the shape of pant leg panels used in standard pull-on pants, except the pant leg panel of the present invention has slightly larger dimensions to facilitate wrapping the panel around the wearer's leg. Each pant leg panel of the present invention, such as right front pant leg panel 40, has a top edge 50, a bottom edge 52, an outer edge 54, and an inner edge 56. When pant leg panel 40 is laid flat, top edge 50 and bottom edge 52 are substantially parallel to each other, and outer edge 54 is substantially perpendicular to both top and bottom edges 50, 52. However, inner edge 56 is not straight, but instead has two curved portions, namely, a crotch edge 60 and an inseam edge 62. Crotch edge 60 curves away from outer edge 54 along a path from top edge 50 to bottom edge 52 to increase the width of panel 40 to provide a comfortable fit when wrapped around a wearer. Slightly less than one-third of the distance between top edge 50 and bottom edge 52, crotch edge 60 ends at junction 61 and inseam edge 62 begins. Inseam edge 62 gently curves back from junction 61 to bottom edge 52 so that inseam 12 of pants 20 is substantially vertical when blank 100 is wrapped around a wearer.

The curvature of inner edge 56 of pant leg panel 40 is similar to that of a standard pant leg panel of step in pants. Preferably, the width of panel 40 from the junction 61 between crotch edge 60 and inseam edge 62 is approximately 35%–40% and preferably 37% wider than the width of panel 40 across top edge 50. Preferably, in both right and left front pant leg panels 40 and 42, the width across top edge 50 is equal to the width across bottom edge 52. In contrast, the top edge of right and left back pant leg panels 44 and 46 is approximately 35%–45%, and preferably 40% wider than the top edge of right and left front panels 40 and 42. Moreover, the top edge of right and left back pant leg panels 44 and 46 is preferably approximately 25%–30%, and preferably 27% wider than the bottom edge of right and left back pant leg panels 44 and 46. These increased dimensions of back pant leg panels 44 and 46, along with darts 48, provide a roomier fit and more coverage in the back portion 32 of pants 10 when blank 100 is wrapped around a wearer. The increased dimensions of back blank portion 122 also allow back blank portion 122 to be overlapped below front blank portion 120, as shown in FIG. 2, so that the wearer's leg is not exposed when walking or when seated. Thus, in accordance with the present invention, four substantially standard pant leg panels are sewn together in a novel manner to form a one-piece pants blank (in contrast to a standard pair of pants already provided with tubular leg portions) that the wearer wraps around herself to form tubular leg portions.

Figure 6:
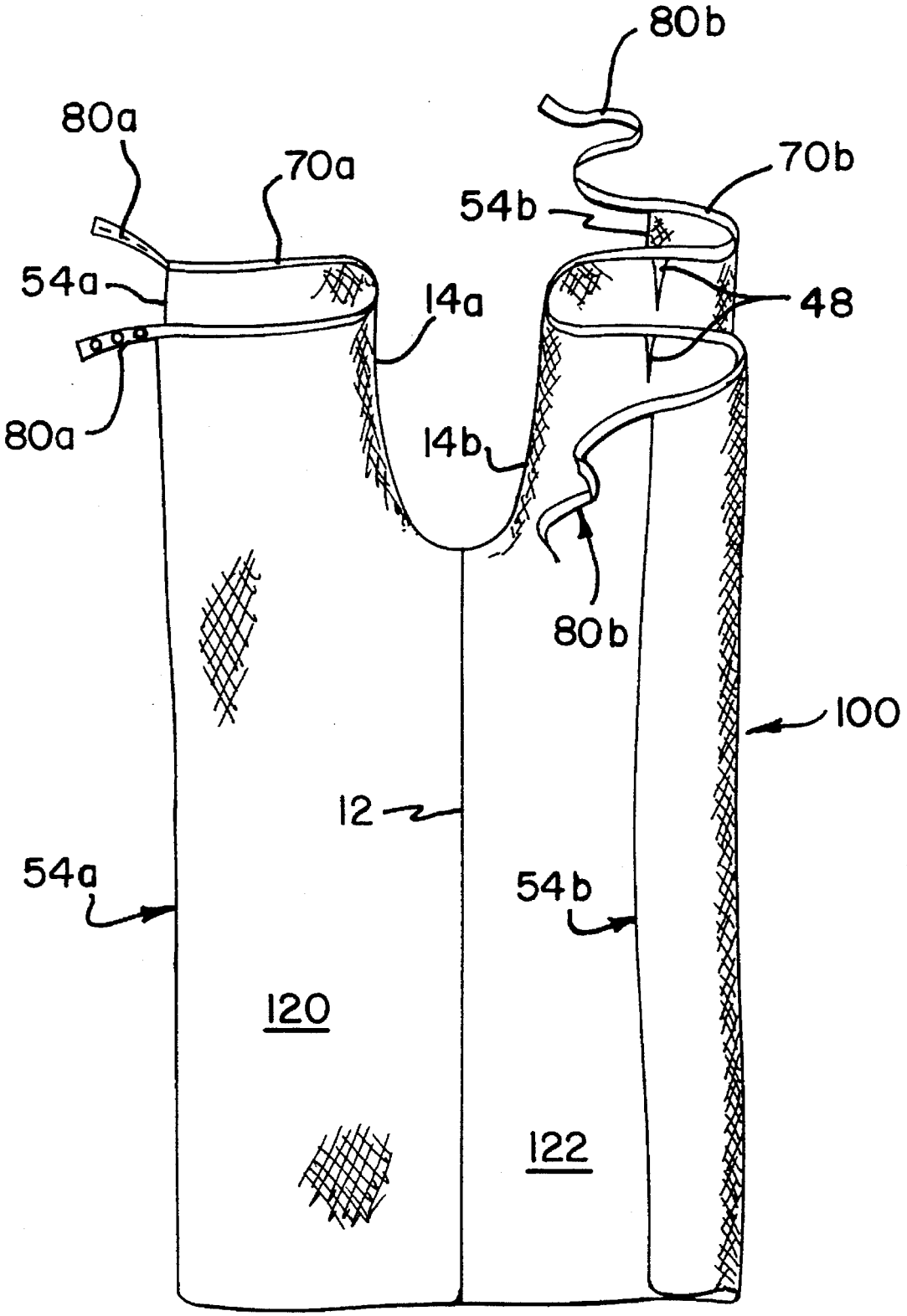
FIG. 6 is an elevational view of the blank of FIG. 1, held for wrapping around a wearer in accordance with the principles of the present invention.

As shown with respect to panel 40, waistband 70 is provided along top edge 50, hem 72 is provided along bottom edge 52, and stitching 74 is provided along outer edge 54 (the outer edges of each panel are not to be sewn together, as understood from FIGS. 2 and 3, showing blank 100 wrapped in a pants configuration) to provide a neat, finished look to the edges of blank 100 when wrapped around the wearer to form pants 10. Waistband 70 has a closing means 80, such as a cloth or string tie, at the meeting point of top edge 50 and outer edge 54. As shown in FIG. 1, each pant leg panel 40, 42, 44, and 46 has a cloth tie closing means 80 so that each of front edge 20 and back edge 22 has opposed closing means 80. The invention is not limited to use of a cloth tie or string as the closing device and other closing means such as buttons, snaps, hooks and eyes, or hook and loop material (offered under the trademark VELCRO) may be used to join the pant leg panels of the garment together at the waist. Such other closing means may be provided on an extension of waistband 70 shorter than an extension needed to form a tie closure (see FIG. 6). Closing means 80*b* along back edge 22 is preferably a tie closure to allow for total adjustability and maximum comfort of the wrapped pants, while front closing means 80*a* is preferably a closure other than a tie for a more tailored look at back portion 32 of pants 10.

In accordance with the method of the present invention, a substantially flat piece of fabric formed of four pant leg panels sewn only along the inseams and crotch seams, such as pants blank 100, is wrapped around the wearer, like a diaper, to look like an ordinary pair of pants. To simplify donning of the pants, first back blank portion 122 is wrapped around the wearer and secured around the wearer's waist by back closing means 80*b* on back waistband 70*b*, as shown in FIG. 4. Side edges 54*b* of back blank portion 122 are positioned at the front portion of the wearer's legs to form front edges of pants 10. Once back blank portion 122 is secured, front blank portion 120 is pulled between the wearer's legs, as shown in FIG. 4, to the raised position shown in FIGS. 6 and 7. Crotch seam 14 extends between waistbands 70*a* and 70*b* and inseam 12 is substantially vertical. The side edges 54*a* of front blank portion 120 are then wrapped over side edges 54*b* of back blank portion 122 (the front edges of pants 10 thereby being covered) and around the wearer to the back side of the wearer to form back edges of pants 10. Front closing means 80*a* is then secured at the back of the wearer.

Figure 7:
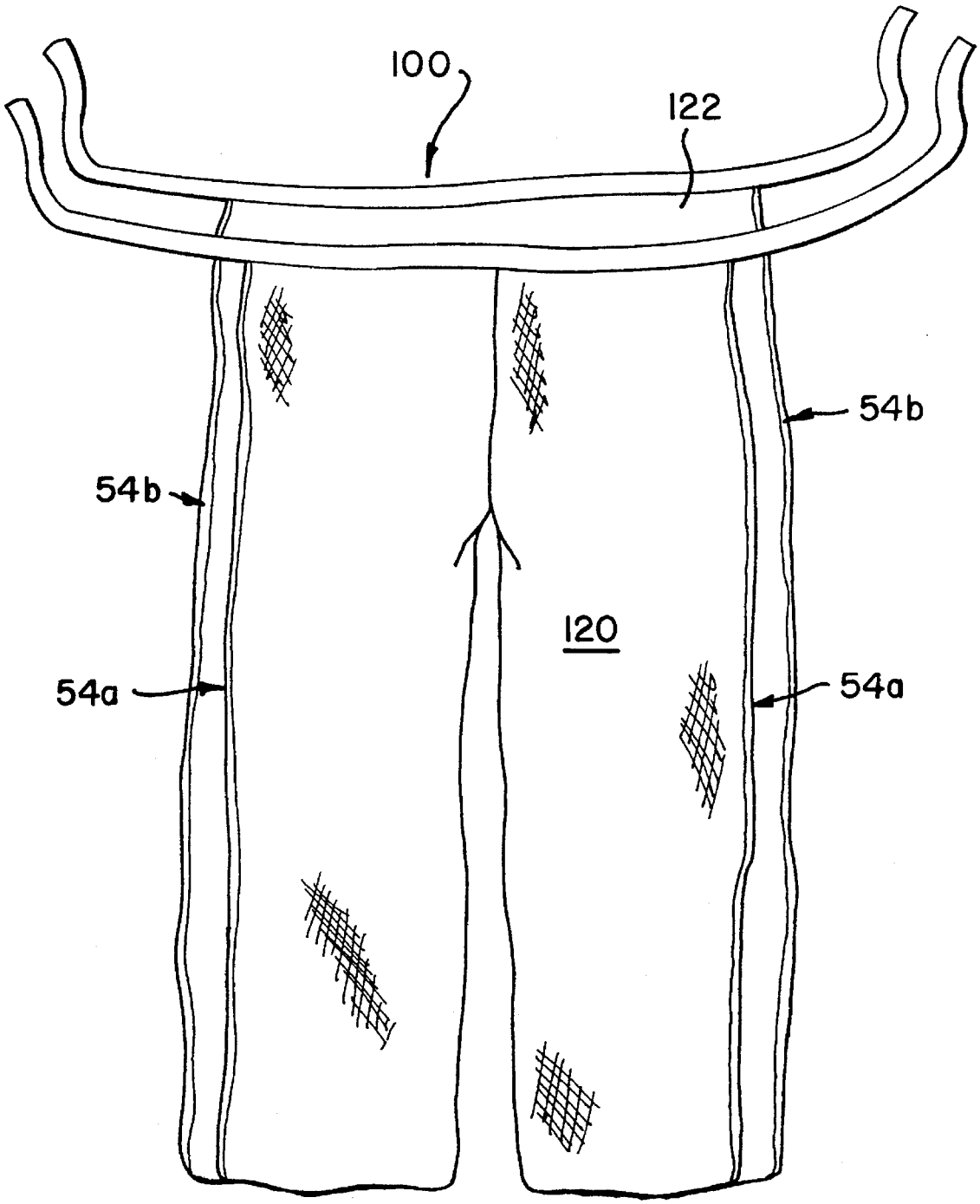
FIG. 7 is a front view of the blank of FIG. 1, held as in FIG. 6.

As may be more easily seen in FIGS. 1 and 7, back blank portion 122, forming bank pants portion 32 is preferably wider than front blank portion 120 forming back pants portion 30 so that there is a substantial overlap of material once blank 100 is wrapped around the wearer, thereby providing full cover when the wearer is walking or is seated. Thus, the side edges 54*b* of back portion 32 extend to the front of the wearer's leg, as seen through cut-away 31 in FIG. 1. The side edges 54*a* of front portion 30 extend to behind the wearer, as seen in FIG. 2. The completely wrapped and secured pants 10 thus result in an overlapped area at the back side of the wearer, as seen in FIG. 2. The only stitched seams in the pant legs are in the inside, along inseam 12 and crotch seam 14, the outside edges of the front 30 and back 32 portions of the pants 10 being stitched at the edge (i.e., finished, like hems 72) but otherwise left open. From the front, as seen in FIG. 2, pants 10 of the present invention can barely be distinguished from ordinary step-in type pants that have pre-formed tubular leg portions. Although the wrap around pants of the present invention are primarily intended to be worn by women, they can also be worn by men.

While the foregoing description and drawings represent the preferred embodiments of the present invention, it will be understood that various additions, modifications and substitutions may be made without departing from the spirit and scope of the present invention as defined in the accompanying claims.

What is claimed is:

1. A pair of pants comprising:

a blank of material that can be laid substantially flat, said blank having a front portion, a back portion, a front waistband along a free edge of said front portion, and a back waistband along a free edge of said back portion, said front portion having a pair of free edges substantially perpendicular to said front waistband and forming substantially parallel back edges of said pants when said blank is wrapped around a wearer, and said back portion having a pair of substantially parallel free edges forming front edges of said pants when said blank is wrapped around a wearer;

means located on said front waistband for indepedently securing said front portion of said blank around the waist of a wearer upon wrapping said blank into a pants configuration; and means located on said back waistband for independently securing said back portion of said blank around the waist of a wearer upon wrapping said blank into a pants configuration;

wherein said front and back portions overlap sufficiently without being attached to each other to permit coverage of the legs of the wearer and attachment of said pants around the wearer being achieved solely by means of said closing means on said front and back waistbands.

2. A pair of pants as in claim 1, wherein:

said front portion of said blank further comprises a right pant leg panel and a left pant leg panel joined along a crotch seam;

said back portion of said blank further comprises a right pant leg panel and a left pant leg panel joined along a crotch seam; and said front portion and said back portion are joined along an inseam.

3. A pair of pants as in claim 2, wherein said blank of material has a plurality of areas of excess fabric that prevent said blank from being completely flat and that allow said blank to be wrapped around the legs of a wearer into a pants configuration in which the legs of the pants are substantially smooth and straight in a vertical direction and in which said pants fit smoothly between said waistbands and said pants legs.

4. A pair of pants as in claim 1, wherein;

said front portion and said back portion are joined along an inseam; and said back portion is wider than said front portion in a direction perpendicular to said inseam so that said front and back portions overlap sufficiently to permit full cover when said pants are worn by the wearer.

5. A pair of pants as in claim 1, wherein said closing means is selected from the group consisting of: a pair of ties, at least one pair of complementary buttons and buttonholes, snaps, at least one pair of complementary hooks and eyes, and hook and loop material.

6. A pair of pants as in claim 1, wherein:

said closing means on said back portion is a tie; and said closing means on said front portion is selected from the group consisting of: at least one pair of complementary buttons and buttonholes, snaps, at least one pair of complementary hooks and eyes, and hook and loop material.

7. A pair of pants comprising:

a right front pant leg panel:

a left front pant leg panel;

a right back pant leg panel; and a left back pant leg panel; wherein:

each of said pant leg panels is formed in a pant leg shape having a top edge, a bottom edge parallel to said top edge, an outer edge extending substantially perpendicularly between said top and bottom edges, and an inner edge extending between said top and bottom edges;

said inner edges each comprise a curved crotch edge and a curved inseam edge;

said right front pant leg panel and said left front pant leg panel are joined only along said crotch edge;

said right back pant leg panel and said left back pant leg panel are joined only along said crotch edge;

said right front pant leg panel and said right back pant leg panel are joined only along said inseam edge;

said left front pant leg panel and said left back pant leg panel are joined only along said inseam edge;

said outer edge of each said panel is free from attachment to any other edge; and each of said pant leg panels is sufficiently wide to permit overlap of said outer edges of said right front and back panels and said outer edges of said left front and back panels so that said pants may be worn, without attaching the outer edges of said pant legs to another pant leg, and without exposing the leg of the wearer.

8. A pair of pants as in claim 7, further comprising:

right front closing means positioned between said top edge and said outer edge of said right front pant leg panel;

left front closing means positioned between said top edge and said outer edge of said left front pant leg panel;

right back closing means positioned between said top edge and said outer edge of said right back pant leg panel; and left back closing means positioned between said top edge and said outer edge of said left back pant leg panel.

9. A method of wrapping a blank of material around a wearer to form a pair of pants, said material having a front waistband and a back waistband opposite said front waistband, said front waistband having a corresponding closing means positioned at the back of the wearer for securing said front waistband, separately and independently of said back waistband, around a wearer, and said back waistband having a corresponding closing means positioned at the front of the wearer for securing said back waistband, separately and independently of said front waistband, around a wearer, said method comprising the steps of:

securing one of said front and back waistbands of said blank of material around a waist of a wearer with a corresponding closing means so that said material is secured around the wearer's waist and partially wrapped around the wearer independently of the other of said front and back waistbands, the remainder of the material hanging from the wearer's waist below the secured waistband;

pulling the material hanging below the secured waistband through the wearer's legs;

lifting the other of said front and back waistbands to the wearer's waist, thereby lifting at least a portion of the material pulled through the wearer's legs, and wrapping said lifted portion of material around the wearer and over material hanging from said one of said front and back waistbands first tied around the wearer's waist to form pant legs having overlapped unattached sides; and securing said other of said front and back waistbands of said blank of material around the waist of the wearer with a corresponding closing means to secure said other of said front and back waistbands around the wearer independently of said first secured waistband;

wherein the blank of material is shaped to result in smooth pant legs and smooth areas between the wearer's waist and legs when wrapped around the wearer, the sides of the pants overlapping each other without being attached.

10. A pair of pants as in claim 8, wherein:

said right and left front closing means cooperate to tie said right and left front pant leg panels around a wearer independently of said right and left back closing means; and said right and left back closing means cooperate to tie said right and left back pant leg panels around a wearer independently of said right and left front closing means.

11. A pair of pants as in claim 1, wherein at least one of said front and back portions covers at least three-quarters of the leg of the wearer.

12. A pair of pants as in claim 11, wherein both said front and back portions cover at least three-quarters of the leg of the wearer.

13. A pair of pants as in claim 7, wherein at least one of said pant leg panels is sufficiently wide to wrap around at least three-quarters of the leg of the wearer.

14. A pair of pants as in claim 13, wherein both said pant legs cover at least three-quarters of the leg of the wearer.

* * * * *